US009099780B2

(12) United States Patent
Cheng

(10) Patent No.: US 9,099,780 B2
(45) Date of Patent: Aug. 4, 2015

(54) ANTENNA DEVICE FOR CIRCUIT BOARD

(71) Applicant: ARCADYAN TECHNOLOGY CORPORATION, Hsinchu (TW)

(72) Inventor: Shih-Chieh Cheng, Hsinchu (TW)

(73) Assignee: Arcadyan Technology Corp., Hsinchu (TW)

( * ) Notice: Subject to any disclaimer, the term of this patent is extended or adjusted under 35 U.S.C. 154(b) by 312 days.

(21) Appl. No.: 13/678,523

(22) Filed: Nov. 15, 2012

(65) Prior Publication Data

US 2013/0214977 A1 Aug. 22, 2013

(30) Foreign Application Priority Data

Feb. 22, 2012 (TW) ..... 101105912 A

(51) Int. Cl.

| | |
|---|---|
| ***H01Q 1/38*** | (2006.01) |
| ***H01Q 1/24*** | (2006.01) |
| ***H01Q 1/48*** | (2006.01) |
| ***H01Q 9/42*** | (2006.01) |

(52) U.S. Cl.

CPC ..... *H01Q 1/38* (2013.01); *H01Q 1/243* (2013.01); *H01Q 1/48* (2013.01); *H01Q 9/42* (2013.01)

(58) Field of Classification Search

USPC ..... 343/700 MS, 702, 833, 841, 848

See application file for complete search history.

(56) References Cited

U.S. PATENT DOCUMENTS

| | | | | |
|---|---|---|---|---|
| 5,220,335 | A * | 6/1993 | Huang | 343/700 MS |
| 5,844,525 | A * | 12/1998 | Hayes et al. | 343/702 |
| 6,326,922 | B1 * | 12/2001 | Hegendoerfer | 343/700 MS |
| 7,486,237 | B2 | 2/2009 | Huang et al. | |
| 7,911,402 | B2 | 3/2011 | Rowson | |
| 2001/0021643 | A1 * | 9/2001 | Itoh | 455/90 |
| 2008/0258979 | A1 | 10/2008 | Lin et al. | |
| 2013/0109449 | A1 * | 5/2013 | Desclos et al. | 455/575.7 |

FOREIGN PATENT DOCUMENTS

| | | |
|---|---|---|
| CN | 101154764 | 4/2008 |
| CN | 101501933 | 8/2009 |
| CN | 102017297 | 4/2011 |
| TW | 538561 | 6/2003 |
| TW | 200803038 | 1/2008 |

OTHER PUBLICATIONS

Chinese Office Action dated Sep. 28, 2014.
English Abstract, TW 200803038.
English Abstract, CN102017297.
English Abstract, TW538561.
TW Office Action, PD4539.

* cited by examiner

*Primary Examiner* — Tan Ho
(74) *Attorney, Agent, or Firm* — Law Offices of John Parrish

(57) ABSTRACT

An antenna device is provided. The antenna device includes a circuit board including a first side configured with a transmission unit, and a second side opposite to the first side; a main radiator disposed at the first side, electrically connected to the transmission unit, and having a major axis direction; a first parasitical radiator adjacent to the main radiator, and coaxially disposed in the major axis direction at the first side; and a second parasitical radiator coaxially disposed in the major axis direction at the second side.

12 Claims, 3 Drawing Sheets

ANTENNA DEVICE FOR CIRCUIT BOARD

CROSS-REFERENCE TO RELATED APPLICATION AND CLAIM OF PRIORITY

The application claims the benefit of Taiwan Patent Application No. 101105912, filed on Feb. 22, 2012, in the Taiwan Intellectual Property Office, the disclosures of which are incorporated herein in their entirety by reference.

FIELD OF THE INVENTION

The present invention relates to an antenna device, and more particularly to an antenna device for a circuit board.

BACKGROUND OF THE INVENTION

Currently, the relationship between the monopole and the circuit is that the transmitter radiates the electromagnetic wave out by a whip-like antenna. However, the whip-like antenna is a stick-shaped or strip-shaped object protruding the electronic device, like the antenna disposed on the past cellphone, router or modem. Therefore, the whip-like antenna occupies much space and is easy to be damaged. Hence, due to the demands of the miniaturization and simple appearance, the built-in antenna becomes the mainstream for most of the current radio products, especially the consuming electronic products.

Please refer to FIG. 1, which shows a conventional radio device. The conventional radio device includes a circuit board 1 having an electronic element area 10. A transmitter 11 is disposed in the electronic element area 10, and a main radiator 20, i.e. an antenna, is disposed on the circuit board 1 outside the area 10 by the printed circuit board technology. The main radiator 20 is electrically connected to the transmitter 11 via the circuit (not shown) in the circuit board 1 so that the electromagnetic wave can be radiated out. However, since the antenna 20 is disposed on the circuit board 1 with electronic elements in the electronic element area 10, the mutual interference between the antenna 20 and the electronic elements is easy to occur. Besides, the electronic elements also hinder the electromagnetic wave from being transmitted. Therefore, the efficiency of the antenna 20 is a little poorer than that of the conventional whip-like antenna.

Please refer to FIG. 2, which is a gain diagram in the prior art. Since the shape of the antenna integrated with the circuit board is not as perfect as that of the conventional whip-like antenna, FIG. 2 is made by using the plane perpendicular to the major axis direction of the antenna as a measuring plane. That is, FIG. 2 is a polar coordinate diagram drawn by using the antenna as the center of a circle. It can be clearly seen from FIG. 2 that from 90° to 270°, the radiation strength of the antenna 20 of FIG. 1 is weakened and not fixed. Taking the user of the wireless modem for example, when he installs the modem, he cannot use the wireless transmission at once; contrarily, he has to adjust the posture of the modem often to enable the angle of the modem having a better radiation strength of the electromagnetic wave to be aimed at the receiving device, e.g. the notebook computer. However, the wireless modem itself has to be connected to the signal source in a wired way, and needs the supply of power. Therefore, the adjustment for the posture of the wireless modem is restricted to the substantial wire. Moreover, if more than two receiving devices respectively at different positions need to use the wireless modem simultaneously, the application is extremely inconvenient. Furthermore, if the wireless modem is fixed on the ceiling or wall, the posture thereof cannot be adjusted at will. Hence, in order to solve the issue of the uneven signal strength, the current technologies all focus on the shape of a single antenna. However, the effect is limited. Otherwise, the way of enhancing the power is performed to solve the issue of the weakened strengths of some angles. However, this not only interferes other external electronic devices but also consumes more power.

In order to overcome the drawbacks in the prior art, an antenna device for a circuit board is provided. The particular design in the present invention not only solves the problems described above, but also is easy to be implemented. Thus, the present invention has the utility for the industry.

SUMMARY OF THE INVENTION

In accordance with an aspect of the present invention, an antenna device is provided. The antenna device includes a circuit board including a first side configured with a transmission unit, and a second side opposite to the first side; a main radiator disposed at the first side, electrically connected to the transmission unit, and having a major axis direction; a first parasitical radiator adjacent to the main radiator, and coaxially disposed in the major axis direction at the first side; and a second parasitical radiator coaxially disposed in the major axis direction at the second side.

In accordance with another aspect of the present invention, an antenna for a circuit board is provided. The antenna includes a main radiator having a major axis direction; and a first parasitical radiator adjacent to the main radiator, and disposed along the major axis direction.

In accordance with a further aspect of the present invention, an antenna for a circuit board is provided. The antenna includes a main radiator providing a first gain, and having a major axis direction; and a first parasitical radiator adjacent to the main radiator, disposed along the major axis direction, and providing a second gain, wherein the first gain overlaps the second gain to form a combined gain.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

The object of the present invention is to enhance the evenness of the radio transmission. That is, various angles of the polar coordinate of the plane perpendicular to the major axis direction all can enable the receiver to receive a nearly identical radio strength. By using the principle of the parasitical circuit, two adjacent antennas generate two sensing currents having opposite directions. This enables the gains respectively generated by the two antennas to cover each other, thereby enabling the direction of a stronger signal generated by one antenna to compensate for that of a weaker signal generated by the other antenna. In this way, the strengths of the radio signals in all directions can all be enhanced, and be nearly identical to each other.

Figure 3:
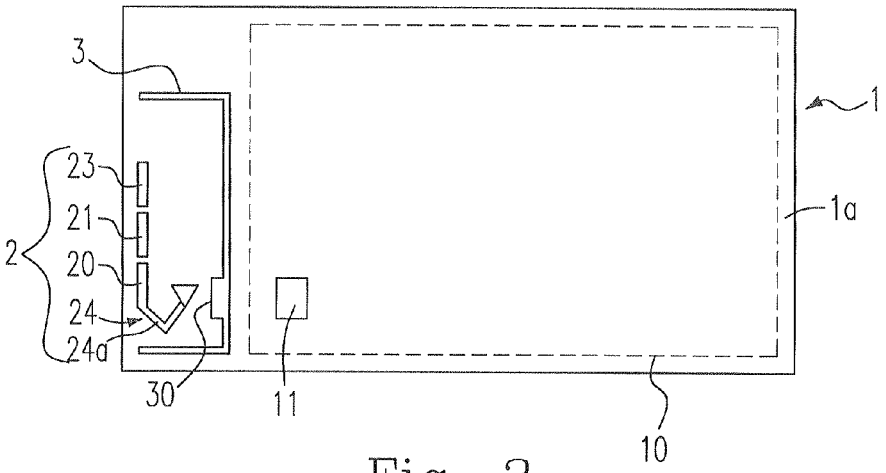
FIG. 3 shows a radio device in the direction of a first side of a circuit board according to an embodiment of the present invention.
Figure 4:
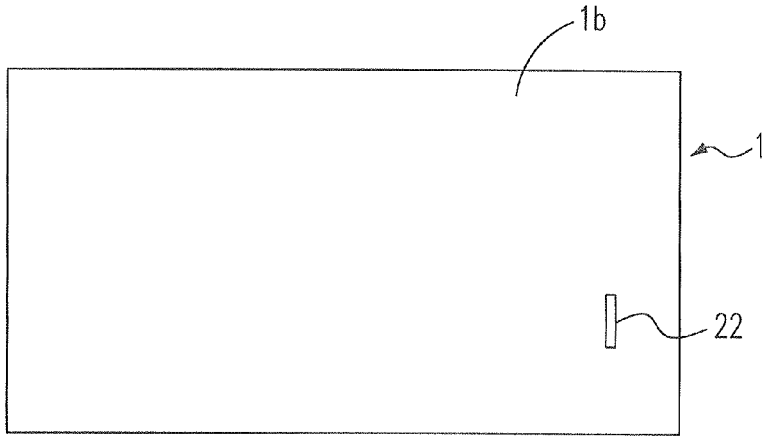
FIG. 4 shows the radio device of FIG. 3 in the direction of a second side of the circuit board.

Please refer to FIGS. 3 and 4. FIG. 3 shows a radio device in the direction of a first side 1*a* of a circuit board 1 according to an embodiment of the present invention. FIG. 4 shows the radio device of FIG. 3 in the direction of a second side 1*b* of the circuit board 1. As shown in FIG. 3, the circuit board 1 has an electronic element area 10. A transmitter 11 is disposed in the electronic element area 10, is electrically connected to a main radiator 20 via a feeding circuit (not shown), and sends a feeding signal to the main radiator 20 via the feeding circuit. Since the gain strength of a single main radiator 20 is actually not even, a first parasitical radiator 21 is further disposed adjacent to the main radiator 20. In this embodiment, the characteristic length of the first parasitical radiator 21 is identical to that of the main radiator 20, and the first parasitical radiator 21 is coaxially disposed along the major axis direction of the main radiator 20. The first parasitical radiator 21 is not electrically connected to the main radiator 20. However, since the first parasitical radiator 21 is adjacent to the main radiator 20, the inductance effect is generated therebetween. Hence, the first parasitical radiator 21 also radiates the electromagnetic wave. Nevertheless, since the electromagnetic wave comes from the inductance effect, the direction of the induced electromagnetic force on the first parasitical radiator 21 is opposite to that on the main radiator 20. Accordingly, the area with an uneven strength generated by the first parasitical radiator 21 happens to stagger that generated by the main radiator 20 so that the respective gains of both are added to become a new gain. Therefore, although the respective strengths of the two radiators 20, 21 are still uneven, they can compensate for each other. Consequently, the present invention indeed can achieve the effect of evening the strength of the electromagnetic wave.

Please refer to FIG. 3 again. In order to prevent the mutual interference between the radiators 20, 21 and the electronic elements in the electronic element area 10, a ground structure 3 is further disposed between the electronic element area 10 and the radiators 20, 21 so that the electromagnetic wave can be converted to the current and guided out when touching the ground structure 3. Besides, in order to further strengthen the effect of the ground structure 3, an impedance matching structure 30 is further disposed on the ground structure 3 with respect to the position of the main radiator 20. The impedance matching structure 30 is wider than other portions of the ground structure 3 for more effectively reducing the interference of the main radiator 20 to the electronic element area 10. Moreover, the main radiator 20 further includes an extending structure 24 having at least a bending portion 24*a* so that the extending structure 24 extends toward the impedance matching structure 30 along the direction away from the first parasitical radiator 21. Through the design of the bending portion 24*a* of the extending structure 24, the interference of the main radiator 20 to the electronic element area 10 can be more effectively reduced.

Please refer to FIG. 4. In order to further strength the effect of compensating for the uneven strength of the electromagnetic wave between the radiators, a second parasitical radiator 22 is further disposed at the backside, i.e. the second side 1*b*, of the circuit board 1. Since the second parasitical radiator 22 overlaps the projection of the main radiator 20, the inductance effect can also be generated so that the electromagnetic wave can be radiated by the second parasitical radiator 22. That is, taking the embodiment of FIG. 3 for example, the present invention has three radiators 20, 21, 22, each of which has its own radiation strength. However, the respective radiation strengths of the three radiators 20, 21, 22 can be added to compensate for each other so that all directions have a similar strength. In this way, the user does not need to adjust the posture of the wireless modem. In addition, if the wireless modem is fixed on the ceiling or wall, the user does not need to move the position of the notebook computer or tablet PC to obtain the best receiving effect.

Please refer to FIG. 3 again. In order to further even the radiation strength, a third parasitical radiator 23 is further disposed on the circuit board 1. The third parasitical radiator 23 is adjacent to the first parasitical radiator 21 but not electrically connected thereto. In this embodiment, the characteristic length of the third parasitical radiator 23 is identical to that of the first radiator 21, and the third parasitical radiator 23 is coaxially disposed along the major axis direction of the first radiator 21. Since the third parasitical radiator 23 is adjacent to the first radiator 21, the inductance effect is generated therebetween. Hence, the third parasitical radiator 23 also radiates the electromagnetic wave. Nevertheless, since the electromagnetic wave comes from the inductance effect, the direction of the induced electromagnetic force on the third parasitical radiator 23 is opposite to that on the first radiator 21. Accordingly, the area with an uneven strength generated by the third parasitical radiator 23 happens to stagger that generated by the first radiator 21 so that the respective gains of the radiators 20, 21, 23 are added to become a new gain. Therefore, although the respective strengths of the three radiators 20, 21, 23 are still uneven, they can compensate for each other. In this way, the present invention can achieve the effect of more evening the radiation strength of the electromagnetic wave. Besides, as shown in FIGS. 3 and 4, the main radiator 20, the first parasitical radiator 21, the second parasitical radiator 22 and the third parasitical radiator 23 can be integrated into an antenna 2. That is, the antenna 2 of the present invention is composed of a main radiator 20 and at least a parasitical radiator.

Figure 1:
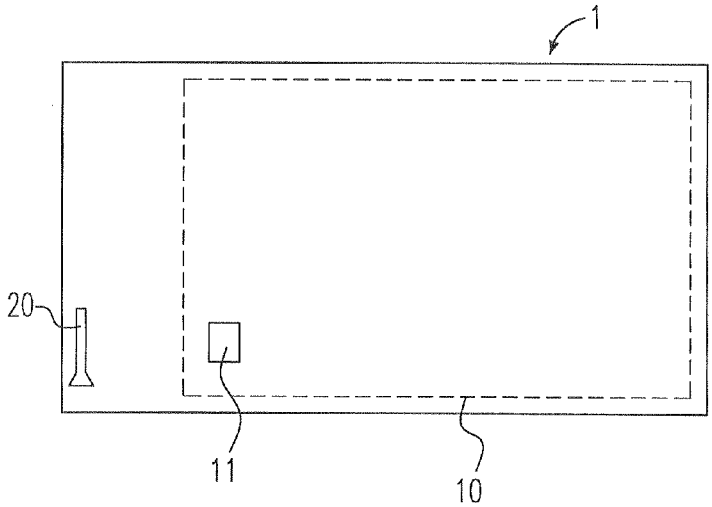
Fig. 1(Prior Art)
FIG. 1 shows a conventional radio device.
Figure 2:
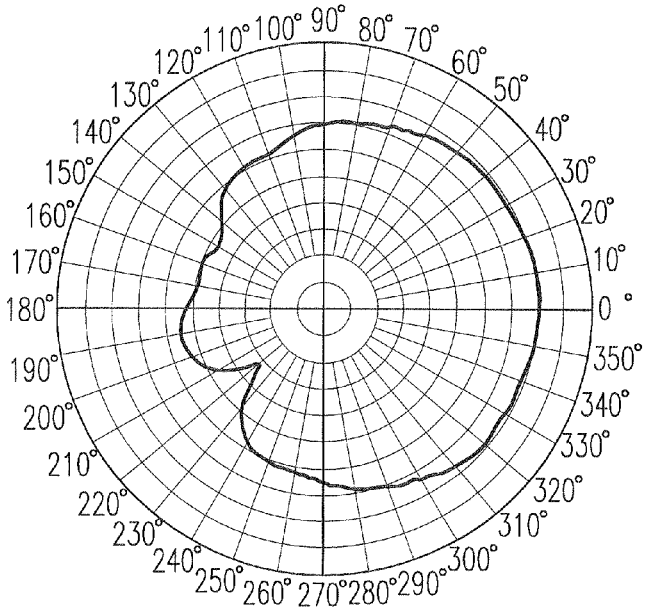
Fig. 2(Prior Art)
FIG. 2 is a gain diagram in the prior art.
Figure 5:
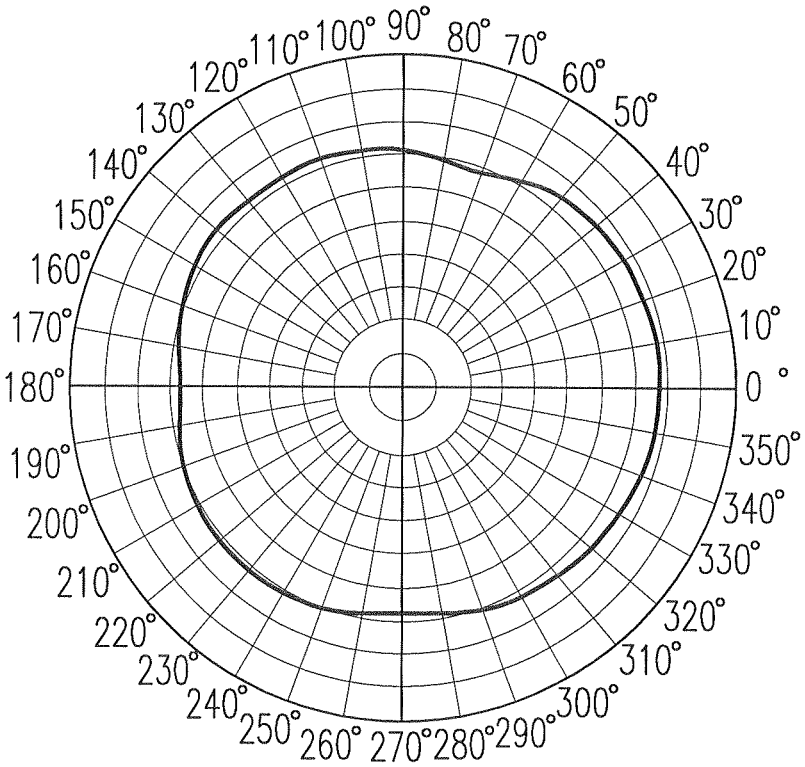
FIG. 5 is a gain diagram according to an embodiment of the present invention.

Please refer to FIG. 5, which is a gain diagram according to an embodiment of the present invention. FIG. 5 is drawn based on the plane perpendicular to the major axis direction of each radiator and on the polar coordinate. Therefore, the present invention uses the parasitical radiator to more even the gain. The difference of the radiation strength of the electromagnetic wave at all angles, i.e. in all directions, can be reduced, which is much better than the prior art as shown in FIG. 1. Hence, the user of the wireless modem of the present invention can receive the radio message with a good signal strength without having to adjust the posture of the wireless modem or his position. It is known from FIGS. 3-5 that the oscillation method for the radio device of the present invention is performed by providing two gains in different directions by different radiators to achieve the effect of compensation. This includes providing a first gain and a second gain, and overlapping the first gain with the second gain to form a combined gain. The first gain can be regarded as being provided by the main radiator 20, and the second gain can be regarded as being provided by the first parasitical radiator 21, the second parasitical radiator 22 and the third parasitical radiator 23. Accordingly, taking the embodiments of FIGS. 3 and 4 for example, each radiator has its own gain, all gains can overlap each other to form a combined gain, and the effect of the radiation strengths in all directions approaching consistency as shown in FIG. 5 can be achieved. Besides, since the generation of the second gain results from the inductance effect, the difference between the phase of the second gain and that of the first gain is about 180 degrees.

Based on the above, the present invention applies the principle of the inductance effect, and coaxially disposes a parasitical radiator along the major axis direction of the main radiator, wherein the parasitical radiator has a characteristic length identical to that of the main radiator. In this way, due to the inductance effect, the parasitical radiator also generates the oscillation and radiates the electromagnetic wave. However, due to the inductance effect, the oscillation direction, i.e. the oscillation phase, of the parasitical radiator approximately differs from the oscillation phase of the main radiator by 180 degrees. Therefore, although both of the main radiator and the parasitical radiator have uneven radiation strengths, they can compensate for each other due to the difference of the phrase so that the strengths of the electromagnetic waves radiated by all angles can approach consistency. That is, all angles can have a good signal reception. Accordingly, through the present invention, the user does not need to adjust the posture of the wireless modem. If the wireless modem is fixed on the ceiling or wall, the user also does not need to move the position of the receiving device, e.g. the notebook computer or tablet PC, since the wireless modem using the technology of the present invention can provide an even radio signal with a sufficient strength for any angles. Hence, the present invention greatly contributes to the radio device for the circuit board, the antenna for the circuit board, and the oscillation method for the antenna for the circuit board.

Embodiments

1. An antenna device, comprising:
   a circuit board including a first side configured with a transmission unit, and a second side opposite to the first side;
   a main radiator disposed at the first side, electrically connected to the transmission unit, and having a major axis direction;
   a first parasitical radiator adjacent to the main radiator, and coaxially disposed in the major axis direction at the first side; and
   a second parasitical radiator coaxially disposed in the major axis direction at the second side.
2. The antenna device of Embodiment 1, further comprising:
   a third parasitical radiator adjacent to the first parasitical radiator, coaxial with the major axis direction, and disposed at the first side.
3. The antenna device of any one of Embodiments 1-2, wherein the main radiator has a projection onto the second side, and the second parasitical radiator overlaps the projection of the main radiator.
4. The antenna device of any one of Embodiments 1-3, wherein the second parasitical radiator has a projection onto the first side, and the circuit board includes an electronic element thereon, the antenna further comprising:
   a ground element adjacent to and surrounding the main radiator, the first parasitical radiator and the projection of the second parasitical radiator for separating the main radiator, the first parasitical radiator and the second parasitical radiator from the electronic element.
5. An antenna for a circuit board, comprising:
   a main radiator having a major axis direction; and
   a first parasitical radiator adjacent to the main radiator, and disposed along the major axis direction.
6. The antenna of Embodiment 5, wherein the circuit board includes an electronic element thereon, the antenna further comprising:
   a ground element adjacent to and surrounding the main radiator and the first parasitical radiator for separating the main radiator and the first parasitical radiator from the electronic element.
7. The antenna of any one of Embodiments 5-6, further comprising a second parasitical radiator.
8. The antenna of any one of Embodiments 5-7, wherein:
   the circuit board has a first side and a second side opposite to the first side; and
   the main radiator and the first parasitical radiator are disposed at the first side, and the second parasitical radiator is disposed at the second side.
9. The antenna of any one of Embodiments 5-8, wherein the main radiator has a projection onto the second side, and the second parasitical radiator overlaps the projection of the main radiator.
10. An antenna for a circuit board, comprising:
    a main radiator providing a first gain, and having a major axis direction; and
    a first parasitical radiator adjacent to the main radiator, disposed along the major axis direction, and providing a second gain, wherein the first gain overlaps the second gain to form a combined gain.
11. The antenna of Embodiment 10, wherein the first gain comes from a first oscillation direction, and the second gain comes from a second oscillation direction.
12. The antenna of any one of Embodiments 10-11, wherein the first oscillation direction differs from the second oscillation direction by 180 degrees.
13. The antenna of any one of Embodiments 10-12, further comprising a second parasitical radiator.
14. The antenna of any one of Embodiments 10-13, wherein:
    the circuit board has a first side and a second side opposite to the first side; and
    the main radiator and the first parasitical radiator are disposed at the first side, and the second parasitical radiator is disposed at the second side.
15. The antenna of any one of Embodiments 10-14, wherein the main radiator has a projection onto the second side, and the second parasitical radiator overlaps the projection of the main radiator.
16. The antenna of any one of Embodiments 10-15, wherein the second gain is provided by the first parasitical radiator and the second parasitical radiator.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An antenna device, comprising:
   a circuit board including a first side configured with a transmission unit, and a second side opposite to the first side;
   a main radiator disposed at the first side, electrically connected to the transmission unit, and having a major axis direction;
   a first parasitical radiator adjacent to the main radiator, and coaxially disposed in the major axis direction at the first side; and
   a second parasitical radiator coaxially disposed in the major axis direction at the second side.

2. An antenna device as claimed in claim 1, further comprising:

a third parasitical radiator adjacent to the first parasitical radiator, coaxial with the major axis direction, and disposed at the first side.

3. An antenna device as claimed in claim 1, wherein the main radiator has a projection onto the second side, and the second parasitical radiator overlaps the projection of the main radiator.

4. An antenna device as claimed in claim 1, wherein the second parasitical radiator has a projection onto the first side, and the circuit board includes an electronic element thereon, the antenna further comprising:

a ground element adjacent to and surrounding the main radiator, the first parasitical radiator and the projection of the second parasitical radiator for separating the main radiator, the first parasitical radiator and the second parasitical radiator from the electronic element.

5. An antenna for a circuit board having a first side and a second side opposite to the first side, comprising:

a main radiator disposed on the first side and having a major axis direction;

a first parasitical radiator adjacent to the main radiator, and disposed on the first side along the major axis direction; and a second parasitical radiator disposed on the second side.

6. An antenna as claimed in claim 5, wherein the circuit board includes an electronic element thereon, the antenna further comprising:

a ground element adjacent to and surrounding the main radiator and the first parasitical radiator for separating the main radiator and the first parasitical radiator from the electronic element.

7. An antenna as claimed in claim 5, wherein the main radiator has a projection onto the second side, and the second parasitical radiator overlaps the projection of the main radiator.

8. An antenna for a circuit board having a first side and a second side opposite to the first side, comprising:

a main radiator disposed on the first side and providing a first gain, and having a major axis direction;

a first parasitical radiator adjacent to the main radiator, disposed on the first side along the major axis direction, and providing a second gain, wherein the first gain overlaps the second gain to form a combined gain; and a second parasitical radiator disposed on the second side.

9. An antenna as claimed in claim 8, wherein the first gain comes from a first oscillation direction, and the second gain comes from a second oscillation direction.

10. An antenna as claimed in claim 9, wherein the first oscillation direction differs from the second oscillation direction by 180 degrees.

11. An antenna as claimed in claim 8, wherein the main radiator has a projection onto the second side, and the second parasitical radiator overlaps the projection of the main radiator.

12. An antenna as claimed in claim 11, wherein the second gain is provided by the first parasitical radiator and the second parasitical radiator.

* * * * *